US007980038B2

(12) United States Patent
O'Neal

(10) Patent No.: US 7,980,038 B2
(45) **Date of Patent: *Jul. 19, 2011**

(54) FASTENER GUIDE FOR SIDING

(76) Inventor: Jerry D. O'Neal, Independence, MO (US)

( * ) Notice: Subject to any disclaimer, the term of this patent is extended or adjusted under 35 U.S.C. 154(b) by 515 days.

This patent is subject to a terminal disclaimer.

(21) Appl. No.: 12/192,730

(22) Filed: Aug. 15, 2008

(65) Prior Publication Data

US 2009/0000244 A1 Jan. 1, 2009

Related U.S. Application Data

(63) Continuation-in-part of application No. 11/683,363, filed on Mar. 7, 2007, now Pat. No. 7,441,383, which is a continuation-in-part of application No. 11/267,055, filed on Nov. 4, 2005, now abandoned.

(51) Int. Cl.
*E04C 2/40* (2006.01)

(52) U.S. Cl. ..... 52/551; 52/573.1

(58) Field of Classification Search ..... 52/506.05, 52/506.06, 512, 518, 520, 523, 526, 539, 52/543, 544, 545, 546, 549, 551, 553, 745.21, 52/748.1, 782.1, 573.1, 309.1, 309.8
See application file for complete search history.

(56) References Cited

U.S. PATENT DOCUMENTS

| | | | | | |
|---|---|---|---|---|---|
| 1,321,958 | A | | 11/1919 | Wardell | |
| 1,357,265 | A | | 11/1920 | Woerheide | |
| 2,632,538 | A | * | 3/1953 | Schmidt, Jr. | 52/520 |
| 3,110,130 | A | * | 11/1963 | Trachtenberg | 52/545 |
| 3,520,099 | A | | 7/1970 | Mattes | |
| 3,552,078 | A | | 1/1971 | Mattes | |
| 3,738,076 | A | * | 6/1973 | Kessler | 52/547 |
| 3,828,510 | A | * | 8/1974 | Bettoli | 52/548 |
| 4,015,391 | A | | 4/1977 | Epstein et al. | |
| 4,047,349 | A | | 9/1977 | Aguilar, Jr. | |
| 4,122,643 | A | | 10/1978 | Hafner | |
| 4,435,933 | A | | 3/1984 | Krowl | |
| 4,435,938 | A | * | 3/1984 | Rutkowski et al. | 52/521 |
| 4,782,638 | A | * | 11/1988 | Hovind | 52/547 |
| 5,016,415 | A | | 5/1991 | Kellis | |
| 5,150,555 | A | | 9/1992 | Wood | |
| 5,339,608 | A | | 8/1994 | Hollis et al. | |
| 5,363,623 | A | | 11/1994 | King | |
| 5,392,579 | A | * | 2/1995 | Champagne | 52/520 |
| 5,490,359 | A | * | 2/1996 | Hepler | 52/506.06 |
| 5,575,127 | A | | 11/1996 | O'Neal | |
| 5,617,690 | A | * | 4/1997 | Gibbs | 52/518 |
| 5,622,020 | A | * | 4/1997 | Wood | 52/546 |
| 5,694,728 | A | | 12/1997 | Heath, Jr. et al. | |
| 5,878,543 | A | | 3/1999 | Mowery | |
| 6,000,185 | A | | 12/1999 | Beck et al. | |
| 6,029,415 | A | | 2/2000 | Culpepper et al. | |

(Continued)

*Primary Examiner* — Robert Canfield
*Assistant Examiner* — Matthew Gitlin
(74) *Attorney, Agent, or Firm* — Erickson, Kernell, Derusseau & Kleypas, LLC

(57) ABSTRACT

A system for attaching a siding panel to a wall uses tubular fastener guide pins supported in spaced relationship by a fastener guide strip. The guide pins extend from the guide strip and through elongate slots in the securement flange of the siding panel. The spacing of the guide pins corresponds to the spacing of centers of elongate slots in the siding panel such that fasteners driven through the tubular guide pins are evenly spaced and allow the panel to slide relative to the guide pins. A layer of insulating foam may be positioned behind the siding panel and with pins sized to extend through the siding panel and foam.

9 Claims, 4 Drawing Sheets

U.S. PATENT DOCUMENTS

| | | | | |
|---|---|---|---|---|
| 6,134,855 | A * | 10/2000 | Beck | 52/520 |
| 6,195,952 | B1 | 3/2001 | Culpepper et al. | |
| 6,295,777 | B1 | 10/2001 | Hunter et al. | |
| 6,367,220 | B1 | 4/2002 | Krause et al. | |
| 6,393,792 | B1 | 5/2002 | Mowery et al. | |
| 6,505,451 | B1 * | 1/2003 | Ksajikian | 52/518 |
| 6,526,718 | B2 * | 3/2003 | Manning et al. | 52/555 |
| 6,718,719 | B1 | 4/2004 | Hagerty | |
| 6,988,345 | B1 * | 1/2006 | Pelfrey et al. | 52/519 |
| 7,225,592 | B2 * | 6/2007 | Davis | 52/547 |
| 7,383,669 | B2 * | 6/2008 | Morse | 52/545 |
| 7,441,383 | B2 * | 10/2008 | O'Neal | 52/551 |
| 7,658,051 | B2 * | 2/2010 | Benes | 52/745.21 |
| 7,712,276 | B2 * | 5/2010 | Gilbert et al. | 52/529 |
| 7,779,594 | B2 * | 8/2010 | Mowery et al. | 52/539 |
| 2002/0029537 | A1 | 3/2002 | Manning et al. | |
| 2002/0043037 | A1 | 4/2002 | Dorsey et al. | |
| 2004/0003566 | A1 | 1/2004 | Sicuranza | |
| 2005/0072093 | A1 | 4/2005 | King | |
| 2006/0053734 | A1 | 3/2006 | Anderson | |

* cited by examiner

FASTENER GUIDE FOR SIDING

CROSS REFERENCE TO RELATED APPLICATION

This application is a Continuation-in-Part of U.S. application Ser. No. 11/683,363 entitled Fastener Guide for Siding, filed Mar. 7, 2007, which is a continuation in part of U.S. application Ser. No. 11/267,055, entitled FASTENER GUIDE FOR SIDING, filed Nov. 4, 2005.

BACKGROUND OF THE INVENTION

This invention relates to siding panels for covering the exterior of buildings and more particularly to a fastener guide used to facilitate proper location of fasteners along the length of a siding panel.

Vinyl siding is produced in a multitude of colors and styles, typically through extrusion of heated, colored plastic through a die shaped to impart the desired cross-sectional profile. The texture of the panel faces may be made to resemble wood clapboards or shingles. The most common type of individual vinyl siding panels resemble two courses of wooden clapboards attached to one another; other types resemble single clapboards. Siding panels are nailed or screwed through horizontally extending slots formed in a nailing flange molded into the top of each siding panel in order to attach the panels to the exterior wall of a building to be clad in siding.

Vinyl siding is typically installed using lock-together panels or sub-components designed to accommodate the expansion and contraction of the vinyl material that typically occurs with temperature variations. This expansion and contraction can be quite significant in siding applications where long panels of siding are utilized. Vinyl siding can distort if installed improperly—particularly if fasteners are not properly placed within the can distort if installed improperly—particularly if fasteners are not properly placed within the elongated slots provided in the nailing flange. A fastener should be placed in the center of a slot so that movement of the siding relative to the fastener can occur in either direction. In addition, fasteners should be attached loose enough to allow siding to slide past the fastener without binding.

In one common siding panel design, a J-shaped channel or trough is molded into the bottom of each siding panel, typically by forming the bottom edge of the panel so that it turns rearward (toward the wall) and upward. A generally U-shaped lip projects forward and downward from the panel near the bottom margin of the nailing flange. This lip is sized to interlock or fit within the channel of the above panel which is installed to overlap and overlie the nailing flange and lip of the panel below. Therefore, the bottom of each panel can be hooked onto the top portion of the previously installed panel below it and the nailing flange and nails are concealed by the overlying, upper panel. Even if double course panels are installed, therefore, it should not be evident to the observer which courses belong to a given panel; rather, the courses should present the appearance of individually installed courses of lap siding.

Unfortunately, during installation it is not uncommon for the installer to drive fasteners into the slots in the nailing flange such that, for example, two adjoining fasteners are each installed outward or each installed inward of the center point in their respective slots thereby limiting the length of travel available for the siding in that location. When such errors occur, distortion or rippling of the panel due to uneven panel movement during expansion or contraction of the panel can be considerable. Such distortion, seen as bending, twisting or outward flaring of individual panels is not only visually unattractive but may allow moisture infiltration to the cladded wall surface. In addition to the above problem of improper fastener placement within the slots, fasteners may be driven into the wall too tightly thereby causing binding even if the fastener is properly placed in the center of the slot.

Therefore there exists a need for a siding installation system that assures proper fastener placement within a nailing slot and that limits binding due to over-tightening of fasteners.

SUMMARY OF THE INVENTION

A system for attaching siding panels to the exterior wall of a building comprises a fastener guide member provided as an elongated strip of resilient material having a generally rectangular cross sectional profile, i.e. relatively wide front and rear faces and relatively narrow top and bottom edges. The strip is sized to fit inside or against the securement flange or nailing hem of a siding panel and includes fastener guides, preferably comprising holes, spaced apart along the length of the strip to align with corresponding slotted apertures in the securement flange. Since fine apertures in the securement flange and the holes in the guide member have equally spaced centers, once one hole in the guide member is positioned in one aperture in the securement flange all the other holes along the length of the guide member will be similarly positioned in their corresponding apertures. During installation or attachment of the siding panels to the wall surface, fasteners such as screws are driven into each guide hole thereby assuring that all fasteners will be centered within securement flange apertures. During later expansion and contraction of the siding panels due to outdoor temperature fluctuations, each panel may simply slide as needed along its associated guide member to relieve internal stresses (which are greatest along the longitudinal axes of the panels). Since the guide members are directly attached to the wall, rather than the panels, and the fasteners are all appropriately spaced within the flange apertures, binding and distortion of the panels is greatly reduced.

In a further embodiment of the system, a collar is provided surrounding each guide hole, at least on the rearward side of the guide member but alternatively on each side thereof. The collars on the rearward side of the guide member are sized diametrically to pass through the corresponding apertures in the securement flange to thereby make contact with the attachment wall surface. These rearward collars are typically generally cylindrical in shape and of a length that exceeds the thickness of the flange so that even upon tightening of a fastener the collar causes the guide member to stand off from the wall a sufficient distance to prevent binding of the flange. In other words, the collars reduce friction between the flange and the wall surface by providing space for the flange to slide along the guide member even though the guide member itself is tightly fastened to the wall.

Other advantages of the invention will become apparent from the following description taken in connection with the accompanying drawings, wherein is set forth by way of illustration and example an embodiment of the present invention.

DETAILED DESCRIPTION

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
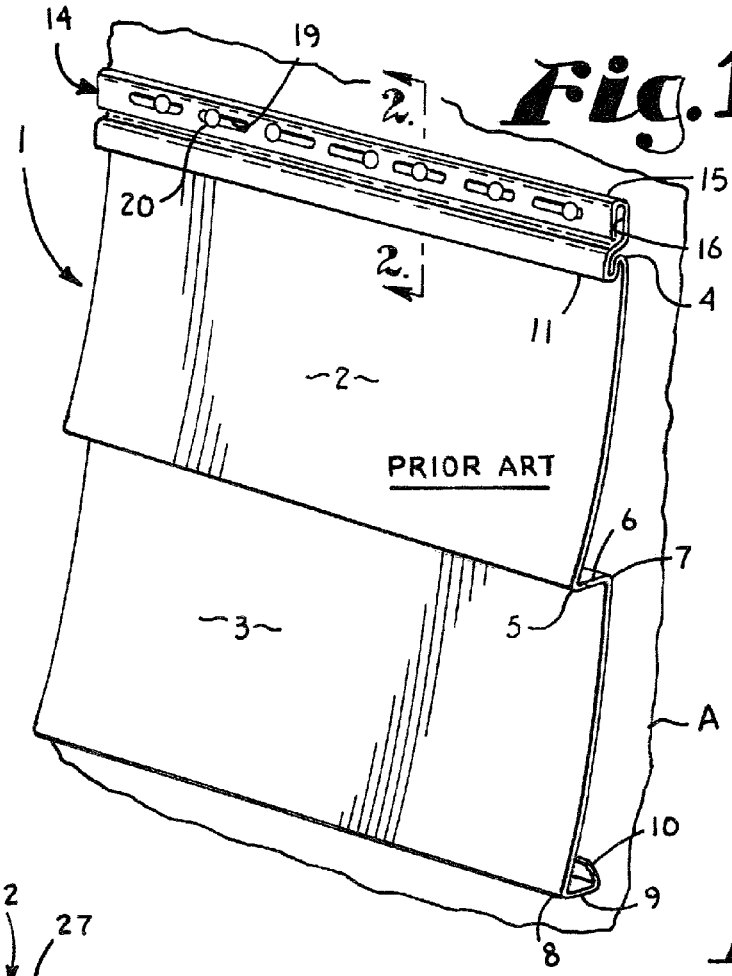
FIG. 1 is a perspective view of a siding panel according to the prior art.
Figure 2:
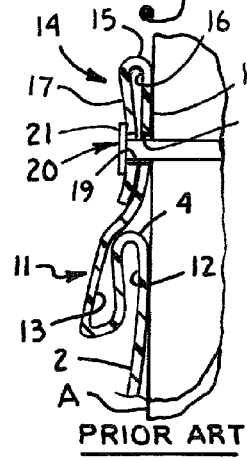
FIG. 2 is a partial cross sectional view of the siding panel taken along line 2-2 in FIG. 1.

With reference to the drawings, FIGS. 1 and 2 illustrate a prior art siding panel 1 attached to an attachment surface or substrate A such as the exterior wall of a building. The panel 1 includes an upper panel section 2 and a lower panel section 3. The upper panel section 2 has an upper edge 4, from which the upper panel section 2 extends downward and forward to a lower edge 5, and a shoulder 6 that projects rearward from the lower edge 5. At a position sufficiently rearward to approximate the plane of a prospective attachment surface A, the shoulder merges with an upper edge 7 of the lower panel 3. The lower panel 3 extends downward and forward from its upper edge 7 and then projects rearward at its lower edge 8 to form a shoulder 9. A lip 10 extends generally upward from an upward bend at the rearward margin of the shoulder 9, thereby forming an upward facing, U-shaped channel or trough defined by the face of the lower panel 3 and its shoulder 9 and lip 10.

A lip 11 is formed along the upper edge 4 of the upper panel section 2 as an extension projecting downward and frontward from the upper edge 4 to form a downwardly opening U-shaped channel 12 along the upper edge 4 and then curving forward and upward to form an upwardly and rearwardly opening L-shaped channel 13. A rearward bend from the top of channel 13 returns to generally meet the vertical plane of a prospective attachment surface and then continues upward generally along said plane to form a nailing hem, fastener strip or securement flange 14. A forward and downward bend at the top 15 of the nailing hem 14 creates a downwardly opening U-shaped channel 16 extending between a forward wall 17 and a rearward wall 18 of the nailing hem 14. Both walls 17 and 18 of the nailing hem 14 have apertures 19 for accepting fasteners 20. Apertures 19 in the forward wall 17 are aligned with apertures 19 in the rearward wall 18 and both sets of apertures 19 are typically shaped as horizontally elongated slots 19.

FIG. 1 illustrates the panel 1 as it would appear attached to a substrate A, including fasteners 20, such as nails 20, driven though slots 19 in the nailing hem 14 of the panel 1 and then into the substrate A. Siding panels 1 of this type are designed to allow for thermal expansion of the panel through the provision of the elongated slots 19 in the nailing hem 14 of the panel 1 so that, in theory, the panel 1 may move, relative to the fixed nails 20, along the slots 19. To allow expansion and contraction of the panel 1 along its length, which may span the entire length of the associated wall, the nails 20 must be spaced uniformly in the slots 19, preferably in the center of each slot 19. Siding panels 1 are typically installed quite rapidly, however, and not always by personnel sufficiently experienced or motivated to center each nail 20 appropriately. As illustrated in FIG. 1, nails 20 are often placed non-uniformly along the length of a siding panel 1 which creates locations where portions of the panel 1 are bound and therefore unable to move along the nails 20. This causes the panel 1 to bend and warp over time, particularly when subjected to wide ranging temperature fluctuations. In addition to being unsightly, warped panels 1 allow for moisture to infiltrate behind the panels 1 to the substrate A which typically causes premature degradation of the substrate A due to weathering effects such as rot and freeze-thaw cycles.

An additional problem of the prior art attachment method described above, that can also lead to binding, is due to nails 20 being too forcefully driven into the attachment substrate A. Ideally, nails 20 are driven into the slots 19 until the nail head 21 touches the outer surface of the forward wall 17. This firmly attaches the panel 1 against the substrate A yet does not create excessive friction between the nail 20 and the panel 1 or the panel 1 and the substrate A. As illustrated in FIG. 2, however, in practice nails 20 are often driven into the substrate A until the hem 14 is pinched between the nail 20 and the substrate A creating considerable resistance to movement of the panel 1 relative to the nail 20 and substrate A. As with improper nail 20 placement within the slots 19, this causes binding that restricts proper uniform movement of the panel 1 relative to the substrate A during expansion and contraction of the panel 1.

FIGS. 3 through 16 include drawings of various embodiments of fastener guides, fastener guide members or fastener guide strips of the present invention that may be used to alleviate binding. The fastener guide members function in cooperation with a siding panel 1 such as the prior art panel 1 illustrated in FIGS. 1 and 2, as well as other panel designs.

Figure 3:
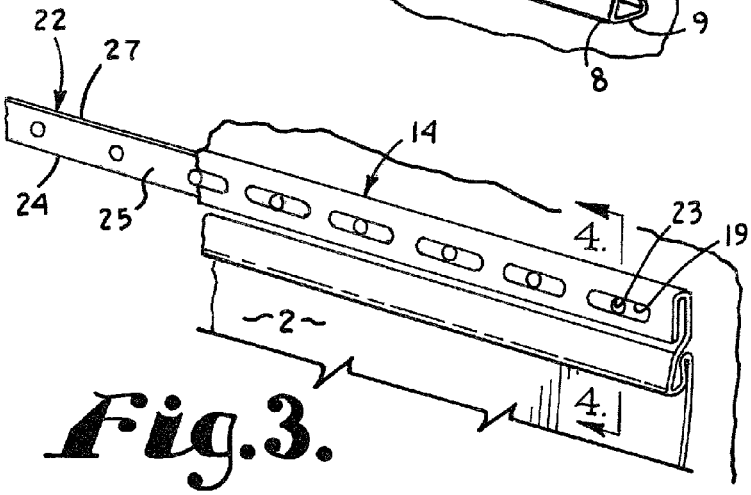
FIG. 3 is a partial, perspective view of a fastener guide member according to the present invention engaged with a siding panel.
Figure 4:
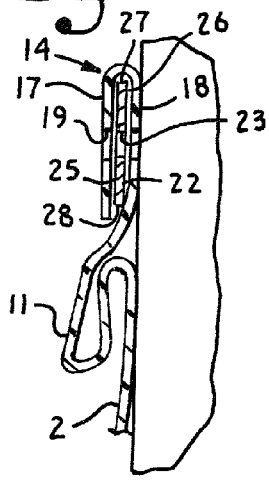
FIG. 4 is a cross sectional view of the siding panel and fastener guide member taken along line 4-4 in FIG. 3.

As illustrated in FIGS. 3 and 4, a first embodiment of a fastener guide member 22 has a main body 24 comprising an elongated strip of resilient material such as plastic or metal having a generally rectangular cross sectional profile. The body 24 has relatively wide front 25 and rear 26 faces and relatively narrow top 27 and bottom 28 edges, as well as relatively narrow first and second opposing ends. The body 24 is sized to cooperate with the nailing hem 14 of a siding panel 1.

In the case of a double-walled nailing hem 14, the guide 22 is sized to fit within the channel 16 of the nailing hem 14 between the forward 17 and rearward 18 walls. Substantially circular holes or guides 23 are formed along the length of the guide 22 to project through the front 25 and rear 26 faces of the body 24 and are evenly spaced apart from one another to align with corresponding apertures 19 in the fastener strip 14 so that a fastener 20 passing through a slot 19 in the forward wall 17 passes through a corresponding hole 23 in the guide member 22 and then through a slot 19 in the rearward wall 18. A cross sectional view of the guide member 22 installed within the fastener strip 14 is provided in FIG. 4.

When engaging a guide member 22 with a siding panel 1, the guide member 22 is positioned, as shown in FIG. 3, so that a first hole 23 in the guide member 22 is aligned with a first slot 19 in the nailing hem 14. Due to the uniform spacing of slots 19 and holes 23, it is thus assured that every hole or guide 23 will be aligned and similarly spaced on its respective slot 19 along the entire length of the panel 1. The guides or guide holes 23 in the guide member 22 are preferably sized slightly larger in diameter than the shaft of the fastener, but smaller than the head thereof, so that driving the fastener into the wall to which the siding is attached does not drive the guide member 22 into the wall and cause binding.

Figure 5:
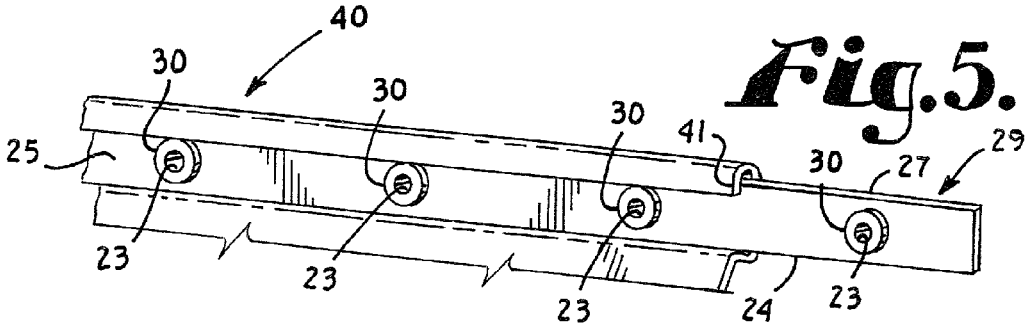
FIG. 5 is a partial, perspective view of an alternative embodiment of a fastener guide member engaged with a siding panel.
Figure 6:
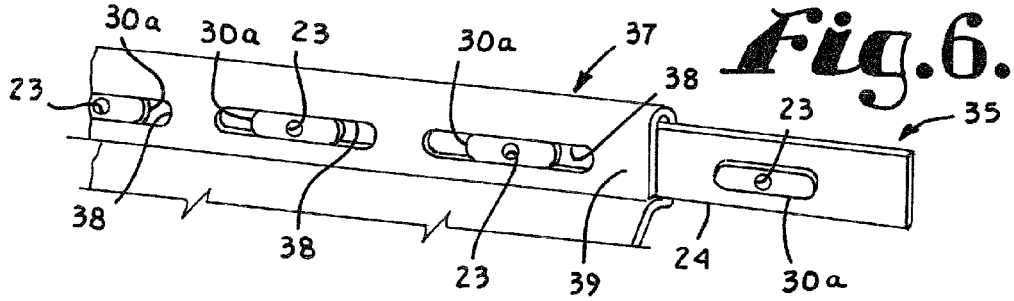
FIG. 6 is a partial, perspective view of a further alternative embodiment of a fastener guide member engaged with a siding panel.

In a further embodiment of a fastener guide member 29, holes 23 are surrounded on the front face 25 of the body 24 by front collars 30 (see FIG. 5). Rear collars 31 may also surround the holes 23 on the rear face 26 of the body 24 (see cross sectional views in FIGS. 7 and 8). The front collars 30 each have a bore that is an extension of the hole 23 in the main body 24 and may include an area of relief in the shape of a frustocone (frustoconical space 32) in the forward-most portion of the collar 30 to accept the head 33 of a screw 34. The rear collars 31 also have a bore that is an extension of the hole 23. The front collars 30, in cooperation with the rear collars 31, create a generally cylindrical overall structure that is able to withstand the substantial force that may be applied when a fastener, such as a screw 34, is driven through the guide member 29 and into the substrate 36.

The collars 30 and 31 may be generally cylindrical in shape or may be ovoid or oblong (see collar 30*a* in FIG. 6) with the larger diameter aligned with the longitudinal axis of a further alternative embodiment of a fastener guide member 35. The rear collars 31 of fastener guide members (such as embodiment 29 or 35) are sized diametrically to pass through the corresponding apertures (slots) 19 in associated nailing hems or fastener strips 14 to thereby make contact with the attachment substrate 36 (see FIG. 7).

Nailing hems or securement flanges of various designs may be used with fastener guides as described in the above embodiments, including a single wall nailing strip (not shown) having only a rearward wall 18. Such a nailing strip could be used with any of the embodiments of the fastener guide described above, the disadvantages of such a strip including, however, lack of a forward wall to hold the guide in place adjacent to the flange prior to installation. For this reason, it is advantageous if the rear collars 31 of the guide fit closely into the apertures 19 in the rearward wall 18 so that friction may hold the assembly in place during installation of the associated panel.

Fastener guide members 22 without collars, as shown in FIG. 3, are easier to utilize with a siding panel 1 having a double wall nailing hem 14, as shown in FIGS. 1 through 4, because the guide member may simply be slid between forward and rearward walls 17 and 18 of the nailing hem 14 after fabrication of the panel 1. The siding panel 1 with the forward and rearward walls 17 and 18 may also be used with embodiments of the guide member 29 having collars 30 and 31 in which case the guide member 29 may be installed during formation of the panel 1. Typically, a panel 1 is formed by an extrusion process. For a siding panel 1 having a double wall nailing hem 14, the siding panel 1 is initially extruded through a dye with the nailing hem 14 extending in a single plane. Two parallel rows of the elongated slots 19 are then formed or cut out of the nailing hem 14, which is then folded over (while still warm or after localized heating) to form the forward and rear walls 17 and 18 of the nailing hem 14. In the present application, the guide member 22 may be inserted adjacent the portion of the planar nailing hem 14 which will form the rearward wall 17 after cutting of the elongated slots 19 and prior to folding of the forward wall 17 over the rearward wall 18. The portion of the nailing hem 14 forming the forward wall 17 is then folded over the portion forming the rearward wall 18 with the guide member positioned between the forward and rearward walls 17 and 18. If the guide member 22 includes collars 30 and 31, the collars 31 may be aligned with the elongated slots 19 in the portion of the hem 14 forming the rearward wall 18 as the guide member 22 is positioned adjacent that portion. The hem 14 is then folded such that the elongate slots 19 in the portion of the hem 14 forming the forward wall 17 align with the collars 30 on the nail guide member 22.

The advantages of using a double wall fastener strip 14 include the ability to securely hold a guide in place prior to installation, including during packaging and shipping. The disadvantages may include loss of the benefits of using guides with collars, if the guide must be slid into place, or the necessity of having to enclose the guide within the walls of the strip during formation of the panel as described above. In the embodiment of a double wall fastener strip 37 (shown in FIG. 6) which is shown used in association with a guide member 35 having oval front collars 30*a* (see FIG. 6) the slots 38 in the forward wall 39 are typically enlarged from those found in prior art panels 1 in order to accommodate the collars 30*a*.

Figure 7:
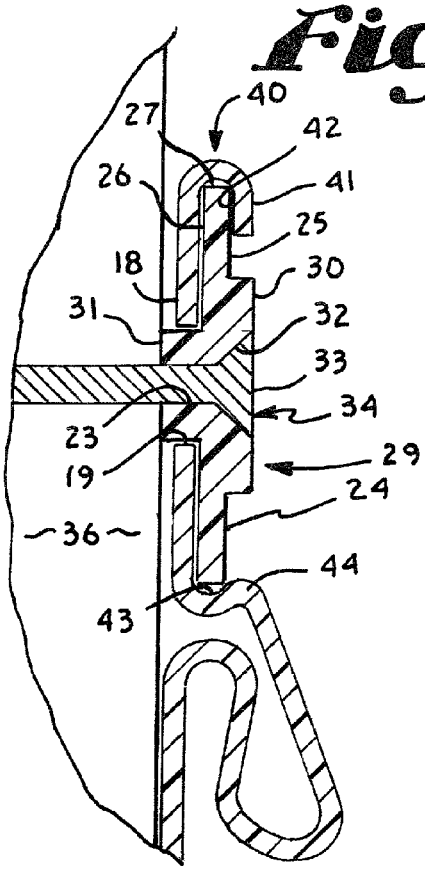
FIG. 7 is a cross sectional view taken along line 7-7 in FIG. 5.
Figure 8:
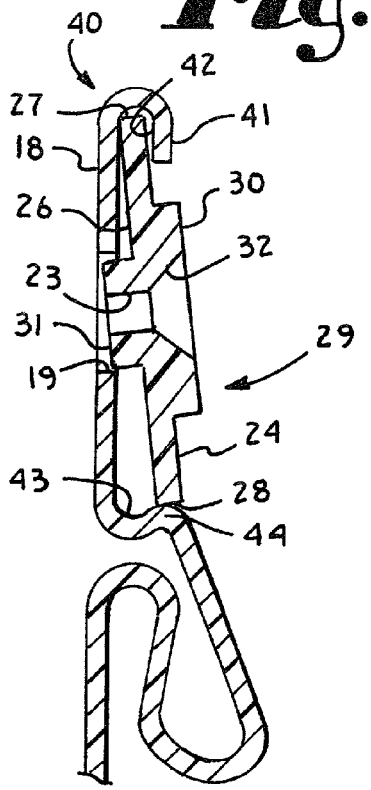
FIG. 8 is a cross sectional view illustrating insertion of a fastener guide member into the fastener strip of a siding panel.
Figure 9:
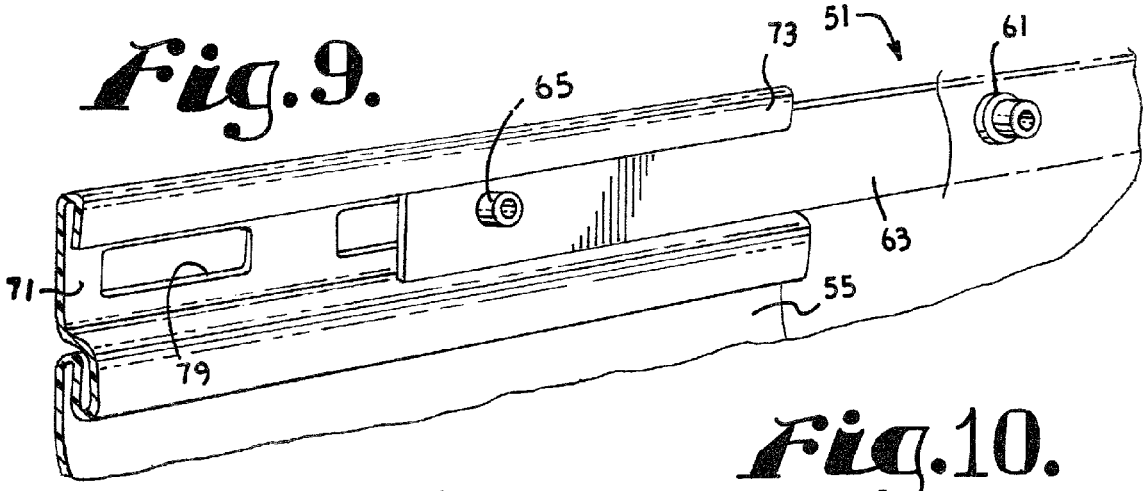
FIG. 9 is a fragmentary perspective view of a further alternative embodiment of a fastener guide assembly engaged with a siding panel with portions broken away to show detail thereof.
Figure 10:
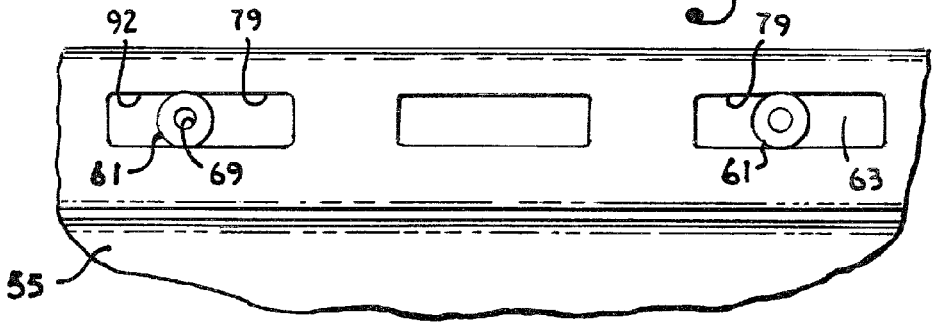
FIG. 10 is a fragmentary rear plan view of the fastener guide assembly as shown in FIG. 9 engaged with a siding panel.

FIGS. 5, 7 and 8 illustrate use of a fastener guide member 29 with a single-wall nailing hem 40 having a lip 41 along the top margin of the hem 40. As with prior embodiments, apertures 19 are evenly spaced along the length of the rear wall 18 of the hem 40. The forward and downward curving lip 41 is provided along the top margin of the hem 40 to form an upper guide engagement channel 42 that holds the top edge 27 of the guide member 29 in place, particularly prior to installation of the panel with fasteners. Advantages of this embodiment of a nailing hem 40 include ease of use with various guide embodiments, including those having forward facing collars 30 or 30*a*, since the lip 41 may be sized to terminate prior to contact with the topmost edge of the collars 30 or 30*a*. As illustrated in FIG. 8, the guide member 29 may be placed in operative position by tilting the top end 27 of the guide member 29 and slipping it into the upper channel 42 then tilting the bottom end 28 of the guide member 29 so that the rearward facing collars 31 are fully inserted into their corresponding apertures 19 and the rearward face 26 of the guide member 29 abuts the wall 18 of the hem 40.

In order to hold the guide member 29 more securely in engagement with the nailing hem 40, the lower portion of the hem may be curved downward to form a lower guide engagement channel 43 to receive the bottom end 28 of the guide member 29 (thereby providing a means for the guide member 29 to snap securely into place). Forward of the lower guide engagement channel 43, a raised ridge 44 also may be provided to assist holding the guide member 29 within the channel 43.

Figure 11:
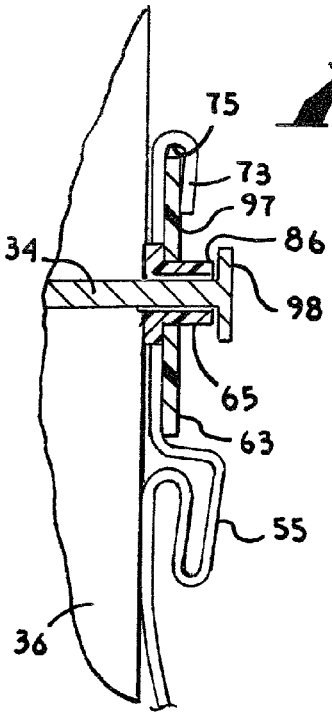
FIG. 11 is an enlarged and fragmentary cross-sectional view taken along line 11-11 of FIG. 9 showing the fastener guide assembly of FIG. 9 securing a siding panel to a substrate using a fastener.
Figure 12:
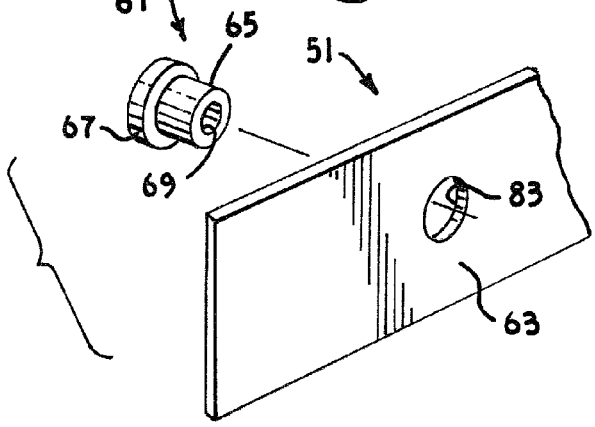
FIG. 12 is a greatly enlarged, fragmentary and exploded view of the fastener guide assembly as in FIG. 9 showing a fastener guide separate from a fastener guide strip forming the fastener guide assembly.

FIGS. 9-12 show a further alternative embodiment of a fastener guide assembly 51 for use in attaching a siding panel 55 to a wall or other attachment substrate 36. The fastener guide assembly 51 includes a plurality of fastener guides 61 formed separate from and mounted on an elongated fastener guide strip 63. Each fastener guide 61 is annular, including a shaft 65, an enlarged head 67 and a central bore 69 extending axially through the shaft 65 and the head 67. The bore 69 is sized to receive the shaft of a fastener such as a nail or screw 34 as best seen in FIG. 11.

In the embodiment shown, the shaft 65 and head 67 of the fastener guide 61 are cylindrical with a round cross-section. It is foreseen that the cross-sectional shape of the head 67 and shaft 65 could be formed in other geometries, such as square or hexagonal which may provide additional functionality.

The siding panel 55 with which the fastener guide assembly 51 is adapted for use is similar in construction to the siding panel shown in FIGS. 5, 7 and 8 having a single-wall nailing hem 71 with a forward and downward curving lip 73 forming an upper guide strip engagement channel 75 for holding a top edge 77 of the guide strip 63 in place.

Apertures or elongate slots 79 are formed in the nailing hem 71 and extend in equally spaced relation generally in horizontal and axial alignment across the nailing hem 71. Slots 79 are generally taller, from a bottom edge to a top edge therefore compared to corresponding slots formed in existing siding systems. In existing siding systems, the slots are generally sized to be slightly taller than the diameter of the fasteners to be driven therethrough and smaller than the head of the fastener. In the disclosed embodiment, the slots 79 are sized just slightly taller (or wider) than the diameter or width of the heads 67 of the fastener guides 61 As will be discussed in more detail hereafter, the heads 67 of the fastener guides 61 are positioned in the slots 79, behind the fastener guide strip 67.

A plurality of guide receiving apertures 83 are formed in the guide strip 63 in equally spaced relation. The centers of the guide receiving apertures 83 are spaced apart a distance equal to or approximately equal to the distance between centers of selectively spaced slots 79. The selected spacing may correspond to the spacing of the centers of adjacent slots 79, every other slot 79, every third slot 79 or so forth. The apertures 83 are sized just slightly larger than the outer diameter or width of the guide shaft 65, such that the shaft 65 of each guide 61 may be snugly inserted or received within a corresponding guide receiving aperture 83 in the guide strip 63. The shafts 65 are inserted into the apertures 83 from what may be referred to as a back or rear face 85 of the guide strip 63 such that the head 67 abuts against the rear 85 of the strip 63 when fully inserted therein. Although not shown, an outer, circumferential edge 86 of each shaft 65 may be chamfered or beveled to facilitate insertion of each shaft 65 into a corresponding aperture 83 in the strip 63.

Fastener guides 61 are preferably inserted in apertures 83 in the guide strip 63 prior to attachment of guide strip 61 to a siding panel 55. The upper edge 77 of a guide strip 63 with guides 61 pre-loaded therein, is first inserted in the channel 75 of lip 73 formed in the nailing hem 71 with the heads 67 of the guides 61 positioned in alignment with the slots 79 in the nailing hem 71. The strip 63 is then pressed toward the nailing hem 71 such that the heads 67 of the guides 61 advance into the corresponding slots 79 in the nailing hem 71.

The fastener guide assembly 51 can be assembled and attached to or installed on a siding panel 55 at the job site or in the factory and shipped to the job site for installation. The siding panel is positioned against a wall 36 with the heads 67 of the guides 61 generally abutting the wall 36. Fasteners, including either nails or screws 34 are then driven through the central bore 69 in each guide 61 and into the wall 36 to attach the siding panel 55 to the wall 36. The fastener guides 61 are preferably formed from a relatively rigid plastic, such as neoprene, which resists deformation when a fastener is driven therethrough.

The fastener guide strip 63 is preferably sized such that an upper edge 77 of the strip 63 supports the nailing hem 71 in the channel 75. The nailing hem 71 may also slide or move relative to the guides 61, such that the siding panel 55 may slide or move laterally relative to the fastener guide strip 63. The fastener guide strip 63 is preferably formed from the same vinyl used to form the siding panel 55, but is preferably approximately twice as thick as the siding panel 55. It is to be understood that the thickness of the fastener guide strip 63 may be greater or less than the thickness of the siding panel 55.

As best seen in FIG. 11, an upper edge of the head 67 of each guide 61, when secured to the strip 63, may also abut against and support the nailing hem 71 adjacent an edge of the nailing hem defining an upper edge of the slot 92. The nailing hem 71 and the associated siding panel 55 can therefore slide or move laterally relative to the fastener guides 61 and the associated heads 67. The guides 61 are preferably formed from a plastic which has a sufficiently low coefficient of friction to facilitate sliding of the siding panel 55 relative to the guides 61 and which is sufficiently rigid to prevent compression of said guide shaft 65 when a fastener is driven therethough. A preferred material of construction of the guides 61 is a neoprene plastic. The head 67 of each guide 61 preferably is thicker than the thickness of the nailing hem 71 to allow sufficient space between the wail 36 to which the siding is mounted and the guide strip 63 to prevent the guide strip 63 from compressing the nailing hem 71 against the wall 36.

The shaft 65 of each guide 61 is at least as long as and preferably longer than the thickness of the guide strip 63, such that a distal end of each guide 61 extends past a front face 97 of the guide strip 63. The shaft 65 of each guide 61 is preferably longer than the thickness of the guide strip 63 to help ensure that the guides 61 stay in the guide receiving apertures 83 before the pre-loaded strips 63 are connected to a siding panel 55.

As with the prior embodiments, by mounting the guides 61 on the guide strip 63 in equally spaced relation and at a distance corresponding to the distance between the centers of corresponding slots 79 in the nailing hem 71, the fasteners 90 inserted through the guides 61 will be properly spaced relative to the slots 79 to prevent binding of the siding 51 upon expansion or contraction.

It is to be understood that the guides 61 do not have to be inserted in every aperture 83, rather the guides 61 may be inserted in selected apertures 83. For example, the spacing and sizing of the slots 79 in the nailing hem 71 and the apertures 83 is preferably selected so that the guides 61 may be spaced sixteen inches or twenty-four inches apart, corresponding to the standard distance between studs of a studwall to which the siding panel 55 is to be attached. Therefore, although the slots 79 may extend in closely spaced relation to one another, and the apertures 83 may be formed in the guide strip 63 to align with every other slot 79, the guides may only be inserted in every other aperture 83 or a varied spacing corresponding to the spacing of studs of a wall to which the siding panel 55 is to be attached. It may be preferred to install the guides 61 in every aperture 83 and then allow the siding installer the discretion of deciding through which guides 61 to drive a fastener 34. It is foreseen that the siding panel 55 could be mounted directly to the studs in a studwall without any plywood or other facing material interposed therebetween.

Figure 13:
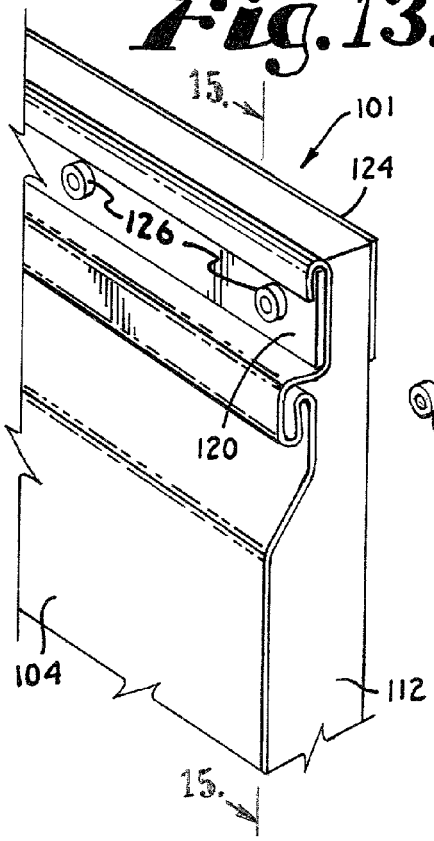
FIG. 13 is a fragmentary, perspective view of an alternative siding panel assembly incorporating a siding panel, a layer of insulating foam and a fastener guide assembly including guide pins.
Figure 14:
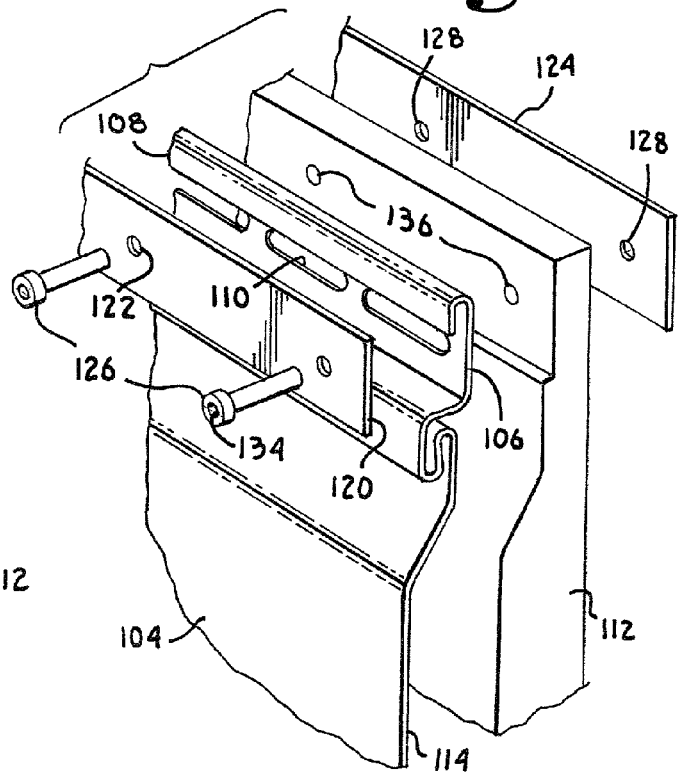
FIG. 14 is an exploded, fragmentary, perspective view of the siding panel assembly shown in FIG. 13.
Figure 15:
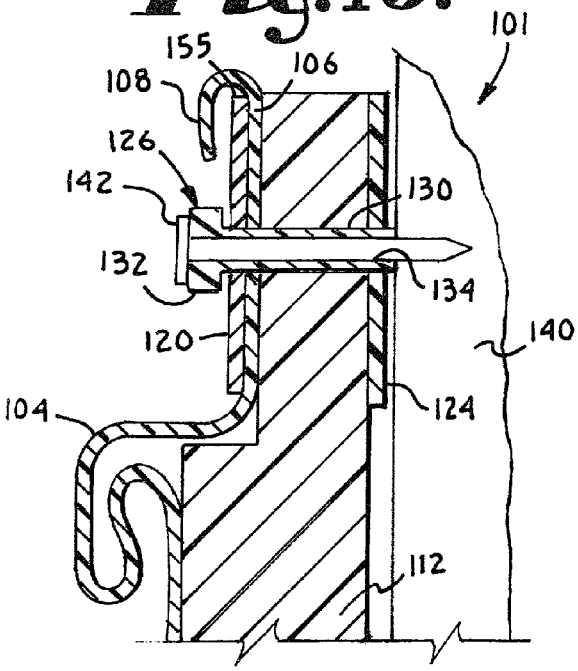
FIG. 15 is an enlarged and fragmentary, cross sectional view taken along line 15-15 of FIG. 13.

An alternative siding panel assembly 101, incorporating a layer of insulating foam, is shown in FIGS. 13-15. The siding panel assembly 101 includes an outer layer or siding panel 104 which is preferably similar in construction to the siding panel 55 discussed previously and may be made of vinyl. The siding panel 104 includes a single wall nailing hem 106 and a downwardly curved lip 108 extending outward and downward from an upper edge of the nailing hem 106. A plurality of slots 110 are formed in spaced relationship through and across the nailing hem 106. In the embodiment shown, the spacing of the slots 110 is preferably an equal spacing of approximately two inches between centers of adjacent slots 110. A layer of rigid insulating foam 112 is positioned against and contoured to conform to a rear surface 114 of the siding panel 104. The foam layer 112 may be adhered to the siding panel 104 or simply positioned against the siding panel 104. In addition, the foam layer may be of a uniform thickness instead of contoured.

The siding panel assembly 101 includes a guide strip 120 similar to guide strip 63 described above and including a plurality of guide receiving apertures 122 formed therein. The assembly 101 further includes a back panel or strip 124 and a plurality of tubular fastener guides, ferrules or pins 126. The back panel 124 is preferably similarly sized relative to the guide strip 120 and includes a plurality of guide receiving apertures 128 formed therein in a spacing corresponding to the spacing of apertures 122 in the guide strip 120. Back panel 124 is also preferably formed from materials such as plastic, vinyl or metal which are sufficiently flexible to permit the panel 124 flex forward and backwards but which does not compress or flex vertically.

Each pin 126 includes a shaft 130 and an enlarged head 132 with a fastener receiving bore 134 extending axially through the pin 126. The shaft 130 of each pin 126 is sufficiently long to allow the shaft 130 to be inserted through an aperture 122 in the guide strip 120, through one of the slots 110 in the nailing hem 106 of the siding panel 104, through a hole 136 in the foam layer 112 and through an aligned aperture 128 in the back panel 124 with the head 132 of the pin 126 positioned proximate the front face of the guide strip 120. The holes 136 in the foam layer 112 are preferably preformed therein by a punch or the like although it is foreseen that the holes 136 could be formed by forcing or punching the pins 126 through the foam layer 112.

The outer diameter of pin shaft 130 is sized slightly larger than the diameter of the apertures 122 in the guide strip 120 and apertures 128 in the back panel 124 to form a friction fit for holding the assembly 101 together. The friction fit is sufficient to hold the assembly 101 together, with the siding panel 104 and foam layer 112 positioned between the guide strip 120 and back panel 124, while the assembly is positioned against a substrate 140 and fasteners 142 (such as nails or screws), are driven through axial bores 134 in the pins 126 and into the substrate 140.

Centers of the apertures 122 in guide strip 120 and apertures 128 in back panel 124 are spaced apart a distance corresponding to the distance between centers of selected elongate slots 110 in the nailing hem or securement flange 106. In a preferred embodiment, the centers of the apertures 122 and 128 are spaced four inches apart, corresponding to one of each aperture 122 and 128 for every two slots 110. It is foreseen that the spacing of apertures 122 and 128 relative to the number of slots 110 could be varied, including one set of apertures 122 and 128 for every slot 110, for every third slot 110 and so on. It is also foreseen that the spacing between the slots 110 could be varied to include random or varied and that the spacing of apertures 122 and 128 would be selected in a pattern or spacing to correspond to the pattern or spacing of selected slots 110. It is also to be understood that the spacing of the holes 136 in the foam layer 112 preferably corresponds to the spacing of the apertures 122 and 128 in the guide strip 120 and back panel 124 respectively. In addition the spacing of the pins 126 and their bores 134 will correspond to the spacing of the apertures 122 and 128 through which they are inserted or relative to which they extend.

When fasteners 142 are driven through tubular guide pins 126 extending through apertures 122 and 128 and holes 136, the fasteners 142 are spaced a distance corresponding to the distance between centers of selected elongate slots 110. The preferred four inch spacing allows the spacing of the fasteners 142 to correspond to a standard sixteen inch spacing of studs in a wall to which the siding panels 104 are to be attached. It is to be understood that fasteners 142 do not have to be driven through every nail guide or pin 126 included in the nail guide assembly 101.

The outer diameter of each pin 126 is smaller than the height of each slot 110 in the nailing hem 106 while the slots 110 are significantly wider than the diameter of the pins 126, such that the siding panel 104 can slide relative to the pins 126 once the pins 126 are secured in place with fasteners 142 driven through the tubular pins 126 and into the substrate 140. By spacing the fasteners 142 a distance apart corresponding to the distance between centers of the corresponding slots 110, the fasteners 142 cannot be positioned to bind the siding panel 104 and prevent the siding panel 104 from sliding.

In addition, the shaft 130 of each pin 126 is sized to be longer than the combined thickness of the siding panel 104, foam layer 112, guide strip 120 and back panel 124 to prevent compression of these separate layers against one another. By avoiding compression of any of the other layers against the securement flange 106 of the siding panel 104, the siding panel 104 is allowed to slide laterally relative to the pins 126, foam layer 112, guide strip 120 and back panel 124.

Figure 16:
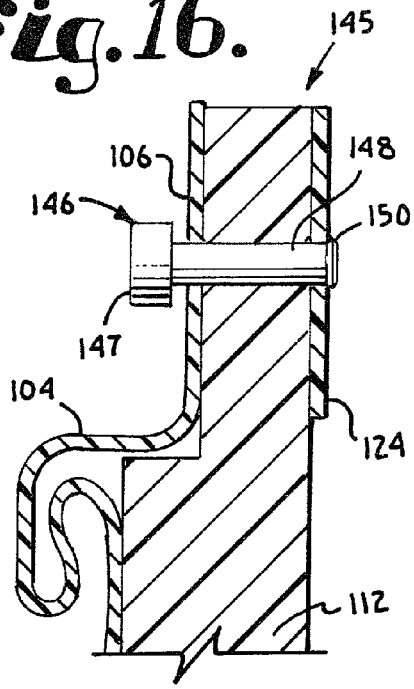
FIG. 16 is a cross-sectional view similar to FIG. 15 showing an alternative embodiment of the siding panel assembly including a siding panel without a downwardly turned lip extending along a securement flange thereof.

Turning to FIG. 16, a modified embodiment of the siding panel assembly 145 is shown with a modified pin 146 having a head 147 and a shaft 148 with a barbed or slightly enlarged end 150. The back panel 124 can be pressed over the end 150 of shaft 148 to hold the back panel 124 adjacent or proximate the foam layer 112. In the embodiment shown either the foam layer 112 or the back panel 124 or both may be described as a fastener guide strip or a fastener guide support member as each functions to support and provide proper spacing for the fastener guide pins 146. As shown, the embodiment 145 does not include the additional guide strip, such as guide strip 120 shown in the embodiment of FIGS. 13-15. It is to be further understood that the layer of foam 112 with appropriate spacing of holes 136 as discussed previously could be used as a fastener guide strip or fastener guide support member without either the front guide strip 120 or back panel 124.

One benefit of use of the front guide strip 120 with the siding panel 104 as shown in FIG. 15 is that an upper edge 155 of the guide strip 120 provides vertical support for the siding panel 104. The upper edge 155 of strip 120 preferably extends in close proximity to the underside the outwardly and downwardly projecting lip 108 of the siding panel 104 to prevent sagging of the vinyl siding panel 104, particularly during hot weather conditions when the vinyl siding becomes more flexible. The use of the back panel 124 further provides structure for holding the assembly 101 or 145 together during installation.

It is foreseen that instead of the back panel 124, a plurality of washers or split washers (not shown) could be utilized with the barbed pins 146, with a washer positioned between the barbed end 150 of each pin 146 and the back of the foam layer 112. As with the pin 126, the length of shaft 148 of pin 140 extending between the enlarged head 147 and barbed end 150 is longer than the combined thickness of the siding panel 104, foam layer 112, guide strip 120 and back panel 124 (or washers) to prevent compression of these separate layers against one another. The pins or fastener guides 126 and 146 are preferably formed from a relatively rigid plastic, such as neoprene, which resists deformation when a fastener 142 is driven therethrough.

It is to be understood that while certain forms of this invention have been illustrated and described, it is not limited thereto except insofar as such limitations are included in the following claims and allowable equivalents thereof. For example it is to be understood that instead of comprising holes, the guides could comprise areas of reduced thickness or score lines or other indicia or markings on or in the guide members 22, 29 or 35 to indicate where the fastener is to be driven. It is also foreseen that the fastener guide strip 63 could be mounted behind the nailing hem 71, in which case the lip 73 would preferably extend across the rear of the nailing hem 71 to assist in holding the fastener guide strip 63 in place. In an application with the fastener guide strip 63 mounted against a rear of the nailing hem 71, the orientation of the fastener guides 61 preferably would be reversed from the orientation shown in FIGS. 9-11. More specifically, the guides 61 would preferably be oriented such that the shafts 65 of each guide 61 project toward and not away from the attachment substrate 36 with the heads 67 of each guide 61 positioned in a corresponding slot 79 in the nailing hem 71.

It is also foreseen that the pins or guides such as guides 61, 126 or 146 could be hollow tubes or dowels without enlarged ends or heads. In addition, it is foreseen that tubular guide pins similar to that shown in FIG. 16, but without the enlarged heads could be integrally formed with the back panel 124. The installer would then select a fastener having a head having a diameter greater than the height of the slots 110 in the siding panel securement flange 106 to prevent the siding panel 104 from slipping off the ends of the pins.

Having thus described the invention, what is claimed as new and desired to be secured by Letters Patent is as follows:

1. A siding panel assembly securable to a wall comprising:

a siding panel having a securement flange extending along an edge thereof and having a plurality of elongate slots formed in said securement flange in spaced alignment;

a fastener guide support member having a plurality of fastener guide receiving apertures formed therein, said fastener guide receiving apertures having centers spaced apart a distance corresponding to the distance between centers of selected elongate slots in said securement flange;

a plurality of fastener guides, each fastener guide extending through a selected elongate slot in said securement flange and a selected fastener guide receiving aperture in said fastener guide support member; said fastener guides sized relative to said elongate slots in said securement flange to permit said siding panel to slide laterally relative to said fastener guides; each fastener guide having a bore through which a fastener may be driven to secure said siding panel assembly to a wall.

2. The siding panel assembly as in claim 1 wherein:

said fastener guides are sized relative to said fastener guide receiving apertures in said fastener guide support member to substantially limit lateral movement of said fastener guides relative to said fastener guide support member.

3. The siding panel assembly as in claim 1 wherein:

said siding panel assembly further comprises a layer of foam positioned behind said siding panel and said fastener guides extend through holes in said foam layer.

4. The siding panel assembly as in claim 1 wherein:

said fastener guides are sufficiently long to extend completely through said siding panel securement flange and said fastener guide support member to prevent pinching of said siding panel securement flange when fasteners are driven through said fastener guides and into the wall.

5. A siding panel assembly securable to a wall comprising:

a siding panel having a securement flange extending along an edge thereof and having a plurality of elongate slots formed in said securement flange in spaced alignment;

a fastener guide support member having a plurality of fastener guides supported thereon in spaced relationship; each fastener guide extending through one of said elongate slots in said securement flange and having an axial bore extending therethrough, through which a fastener may be driven to secure said siding panel assembly to a wall; said axial bores of said fastener guides having centers spaced apart a distance corresponding to the distance between centers of selected elongate slots in said securement flange; said fastener guides sized relative to said elongate slots in said securement flange to permit said siding panel to slide laterally relative to said fastener guides.

6. The siding panel assembly as in claim 5 wherein:

said siding panel assembly further comprises a layer of foam positioned behind said siding panel and said fastener guides extend through holes in said foam layer.

7. The siding panel assembly as in claim 6 wherein:

said fastener guides are sufficiently long to extend completely through said layer of foam and said siding panel securement flange and to prevent pinching of said siding panel securement flange when fasteners are driven through said fastener guides and into the wall.

8. A siding panel assembly securable to a wall comprising:

a siding panel having a securement flange extending along an edge thereof; said securement flange having a plurality of elongate slots extending therethrough in equally spaced alignment;

an fastener guide strip sized for positioning against the securement flange of said siding panel; said fastener guide strip having a plurality of apertures formed therein in spaced alignment along the length of said fastener guide strip; said spacing between said apertures corresponding to the spacing between centers of selectively spaced slots in the securement flange of said siding panel;

a layer of insulating foam positioned behind said siding panel; said layer of insulating foam having a plurality of holes formed therein in spacing corresponding to the spacing between said apertures formed in said fastener guide strip;

a plurality of fastener guides insertable within selected apertures in said fastener guide strip such that each said fastener guide extends through a selected aperture in said guide strip, through a selected slot in said securement flange of said siding panel and through an aligned hole in said layer of foam; each fastener guide having a fastener receiving bore extending therethrough sized to receive a fastener shaft, such that fasteners may be driven through said fastener guides extending through said fastener guide strip, said securement flange of said siding panel, said layer of foam and into a substrate for securing said siding panel assembly to the wall.

9. The siding panel assembly as in claim 8 further comprising:

a back panel having a plurality of apertures formed therein in spacing corresponding to the spacing of said apertures in said guide strip; said back panel positioned behind said layer of foam with distal ends of said fastener guides extending through aligned apertures in said back panel.

* * * * *